US007032348B1

(12) United States Patent
Epps et al.

(10) Patent No.: US 7,032,348 B1
(45) Date of Patent: Apr. 25, 2006

(54) MOTOR OPERATED FAST FOOD SERVICE WINDOW WITH UPWARDLY FOCUSED PROXIMITY DETECTORS

(75) Inventors: Jason T. Epps, Houston, TX (US); Dan L. Terry, Houston, TX (US); Jackson G. Weaver, Cypress, TX (US)

(73) Assignee: Quikserv Corp., Houston, TX (US)

( * ) Notice: Subject to any disclaimer, the term of this patent is extended or adjusted under 35 U.S.C. 154(b) by 811 days.

(21) Appl. No.: 09/004,803

(22) Filed: Jan. 9, 1998

(51) Int. Cl.
*E05F 15/20* (2006.01)

(52) U.S. Cl. ..... 49/25; 49/31

(58) Field of Classification Search ..... 49/25, 49/360, 31; 52/204.51
See application file for complete search history.

(56) References Cited

U.S. PATENT DOCUMENTS

| | | | | | |
|---|---|---|---|---|---|
| 2,341,546 | A | * | 2/1944 | Hagenbook | 362/272 |
| 4,411,102 | A | | 10/1983 | Radek | |
| 4,442,630 | A | | 4/1984 | Radek | |
| 4,560,912 | A | * | 12/1985 | Jonsson | 318/480 |
| 4,577,437 | A | * | 3/1986 | Gionet et al. | 49/25 |
| 4,621,452 | A | * | 11/1986 | Deeg | 49/28 |
| 4,733,498 | A | | 3/1988 | Kriegel | |
| 4,894,952 | A | * | 1/1990 | Trett et al. | 49/25 |
| 5,142,152 | A | * | 8/1992 | Boiucaner | 250/341.7 |
| 5,276,391 | A | * | 1/1994 | Jonsson | 318/480 |
| 5,589,747 | A | * | 12/1996 | Utke | 318/468 |

OTHER PUBLICATIONS

RELTEC Equipment, Inc. Advertisning Brochure, 1998.
Banner T30 Series Fixed-Field Sensors—4 pages.
Banner EZ-Beam Sensors: Dimension Drawings.
Diagram for Banner Fixed Field Sensing and Diffuse Sensing.

* cited by examiner

*Primary Examiner*—Gregory J. Strimbu
(74) *Attorney, Agent, or Firm*—Trop, Pruner & Hu, PC

(57) ABSTRACT

An electrically operated fast-food service window with a plurality of upwardly focused infrared emitter/receivers mounted on the fast-food service window in a manner such that the emitter/receivers emit infrared beams at an angle slightly askew of an imaginary vertical plane. The sensors are used to reliably detect an employee in the immediate proximity of the fast-food service window as the employee bends over the horizontal service shelf adjacent to and attached to the fast-food service window as the employee begins to reach towards a customer. The sensors, although focused towards the interior of a building, do in not detect employees or traffic in the immediate vicinity of the fast-food service window thereby virtually eliminating the unintentional opening of the window. The uniquely oriented sensors are connected to an electric motor operator which opens the window as an employee prepares to deliver merchandise or other items to a customer. As the employee retreats from the fast-food service window area, the sensors then detect the absence of the employee thereby causing the motor operator to close the fast-food service window.

14 Claims, 3 Drawing Sheets

MOTOR OPERATED FAST FOOD SERVICE WINDOW WITH UPWARDLY FOCUSED PROXIMITY DETECTORS

BACKGROUND OF THE INVENTION

This invention pertains to access windows and similar equipment more particularly to access windows for drive-through and walk-up fast food service installations. These access windows are typically provided in a building, such as a fast-food service establishment, a convenience drive-up food store, a service station attendant's booth, a free-standing kiosk, or the like.

The present invention especially relates to access windows typically installed on the side of a building adjacent a driveway or sidewalk to facilitate business transactions between an employee and customer. Such windows are conventionally located in a manner permitting an employee to view the customer approaching his window and to personally transact business with the customer.

In a typical commercial environment a drive-up access window must easily permit the employee to transact business with a customer and yet provide the necessary isolation between the outside environment and the inside environment to satisfy health end safety requirements.

Prior art windows are described in U.S. Pat. No. 4,411,102; U.S. Pat. No. 4,442,630; U.S. Pat. No. 4,733,498; and U.S. Pat. No. 4,641,460. The windows may be actuated solely by manual force or by electrical motors triggered by an employee or by the presence of an employee.

Mechanically operated prior art devices require a substantial amount of physical exertion to operate as many windows in busy fast-food establishments may be operated in excess of 900 times per day. In an effort to reduce the physical strain and exertion associated with such operation many fast-food establishment employees resort to mechanically blocking a window in the open position which violates many local and state health codes. In some cases motor operators have been installed in such windows, however, switches and the like used to trigger the windows also have proven problematic inasmuch as the employees typically must open the windows without the use of their hands. Where automatic sensing means have been used, the auto-sensing means for the motor-operated windows has also proved problematic as the windows open unintentionally due to employee traffic in the proximity of the window or in some cases close inadvertently whenever the employee fails to maintain a physical pose in a manner that breaks an infrared beam or the like.

SUMMARY OF THE INVENTION

The present invention meets the above-mentioned disadvantages by providing a reliable sensor and triggering device for a motor-assisted fast-food service window. The present invention uses an upwardly focused light emitting diode (LED) emitter/receiver sensor in a new and novel fashion that substantially reduces the number of times that a fast-food service window is unintentionally opened while at the same time providing for reliable sensing of an employee in the fast-food window area just prior to providing a customer with food, drinks, change or other items required wherever business is transacted. The invention is further characterized by the application of an infrared emitter/receiver sensor in a manner not requiring a fixed reflective surface to serve in a manner to return the infrared beam from the emitter to the receiver.

The preferred embodiment of the apparatus comprises a plurality of upwardly focused infrared emitter/receivers mounted on the internal side of a fast-food service window at an angle slightly off of the horizontal plane in a manner emitting an infrared beam at an angle slightly askew of the vertical axis. The sensors are used to detect an employee in the immediate proximity of a fast-food service window as the employee bends over the horizontal service shelf as the employee begins to reach towards a customer, that is, as the employee extends an arm over the sensor. The sensors, although focused towards the interior of a building, do not detect employees or traffic in the immediate vicinity of the fast-food service window thereby virtually eliminating the unintentional opening of the window. In the preferred embodiment, the sensor circuit is equipped with a time delay of approximately 0.2 seconds (2/10 seconds) time delay in sensing an object as an additional aid in eliminating false openings and closings of the access window. The uniquely oriented sensors are connected to an electric motor operator which opens the window as an employee prepares to deliver merchandise or other items to a customer. As the employee retreats from the fast-food service window area, the sensors then detect the absence of the employee thereby causing the motor operator to close the fast-food service window.

In the preferred embodiment, the electrically operated service window also is equipped with a switch to facilitate the use of the window by a wheel-chair bound employee or handicapped employee who may not bend over the horizontal service shelf in the traditional manner. In this fashion a wheel-chair bound employee can open the window by operating the switch and thereafter close the window by again operating the switch in the other direction. When the switch is oriented such as to close the window, the window is also returned to the automatic operation phase in a manner that will permit it to again property detect the proximity of an employee reaching across the horizontal service area as such employee reaches towards a customer on the outside of the window, that is, to detect an extended arm of the employee before the torso of the employee is detected.

The various features and principles of the invention will become obvious to those skilled in the art upon review of the detailed description in conjunction with the appended drawings and claims.

BRIEF DESCRIPTION OF THE DRAWINGS

Corresponding reference numbers indicate corresponding parts throughout the several views of the drawings.

DESCRIPTION OF PREFERRED EMBODIMENT

Figure 1:
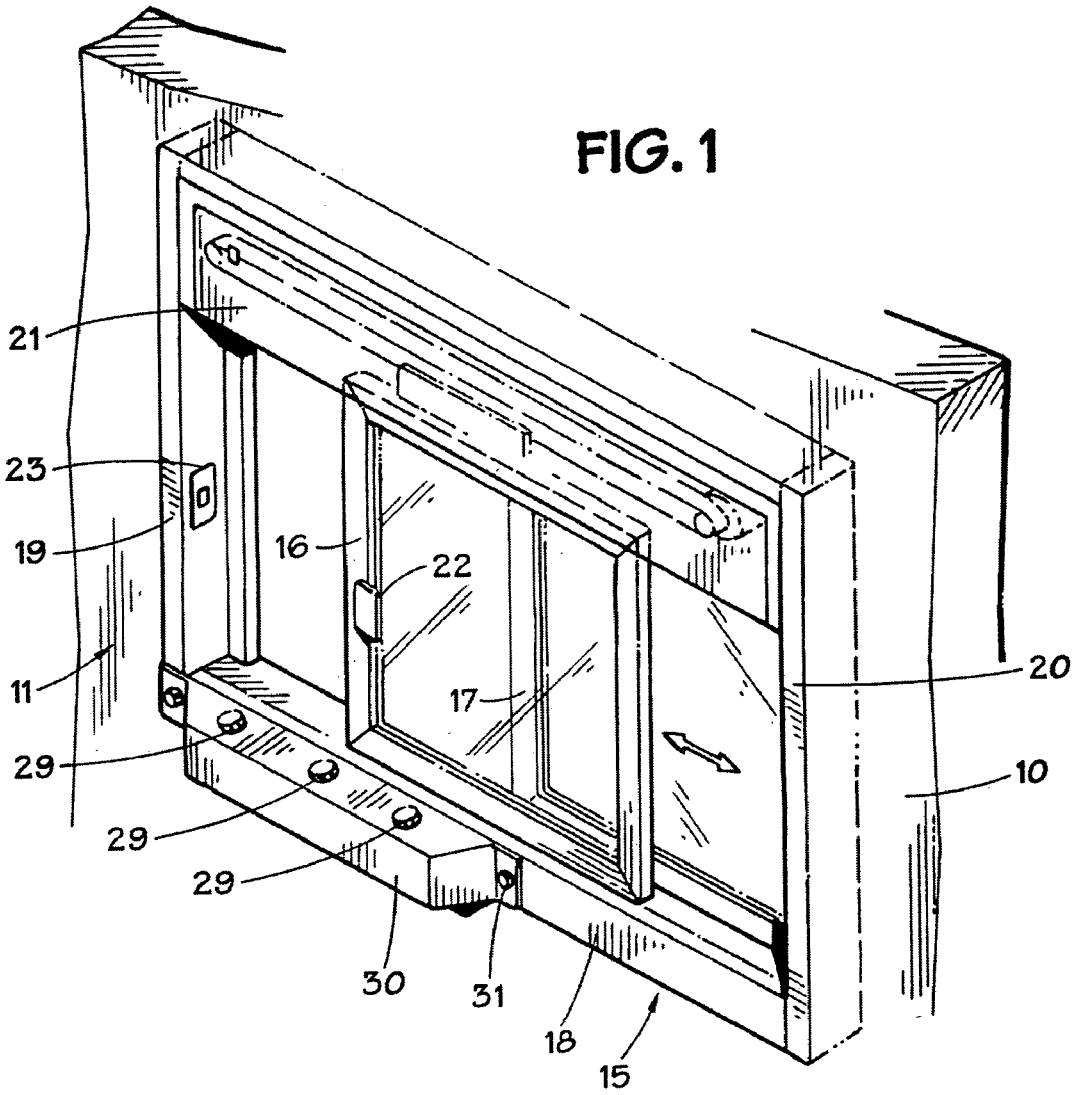
FIG. 1 is a perspective view of the fast-food access window of the present invention with a cut-away of the outer wall of a building, the access window mounted within a window frame, having a motor-operated sliding window pane (so as to permit transactions between the attendant within the building or kiosk and a customer outside the building or kiosk), a fixed window pane, a plurality of upwardly focused proximity sensors mounted on a sensor mount and the sensor mount attached to the bottom frame member adjacent the sliding pane.
Figure 2:
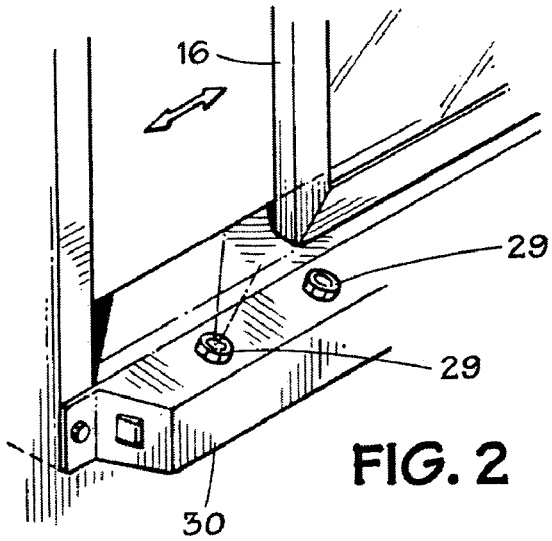
FIG. 2 is a detailed view illustrating the sliding window pane described in FIG. 1 with two proximity sensors mounted on the sensor mount attached to the bottom frame member of the access window frame.
Figure 3:
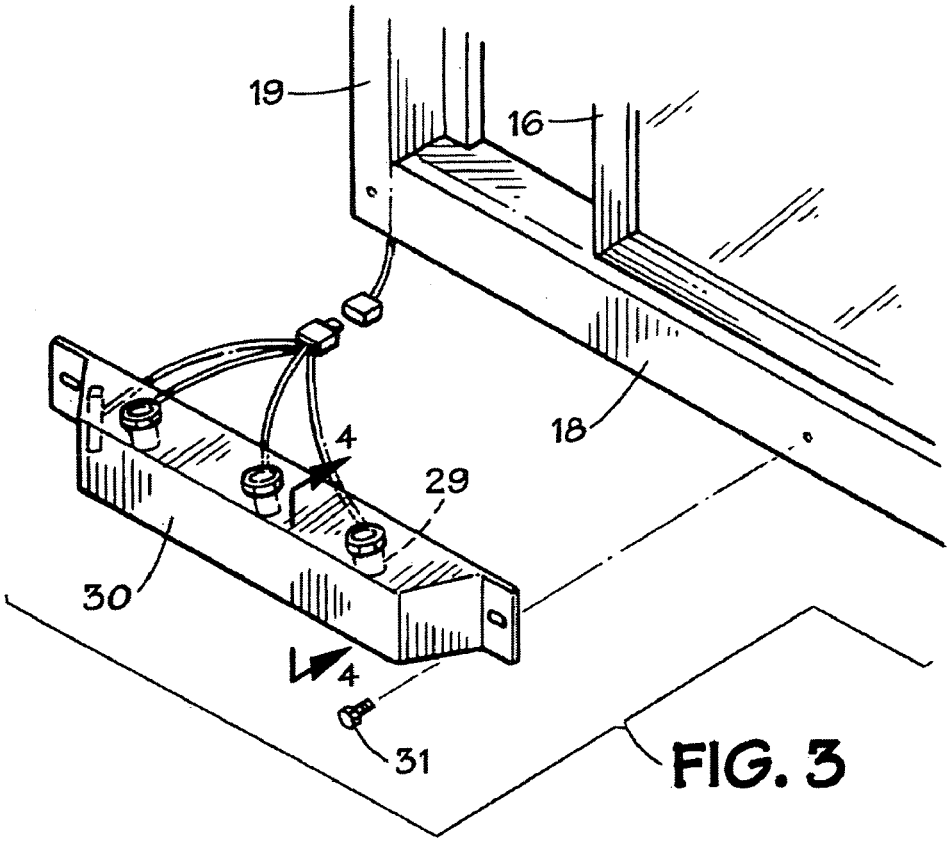
FIG. 3 is a perspective view of the access window of the present invention with a partial view of the access window frame and sliding window pane, and the proximity sensor mount detached from the bottom frame member.

Referring now to the drawings, and with specific reference to FIGS. 1, 2, and 3, a cutaway of a building wall 10 is shown having an inside wall 11 with an access window 15 of the present invention attached. The access window 15, having a sliding window pane member 16, a fixed window pane member 17, a bottom frame member 18, a left frame member 19, a right frame member 20, and a top frame member 21. Although the preferred embodiment features a sliding window pane, a movable window member that is hinged at one end that creates an opening to permit access to a customer is similarly envisioned as an comparable embodiment. The sliding window pane member having a window handle 22 with thumb screw latch 63 located above the handle 22 and latch receiver 23. In the preferred embodiment, the access window frame members are made of stainless steel and the window pane members of tempered safety glass framed with stainless steel members and sealed with rubberized sealing materials in a manner well known by those skilled in the art. The preferred embodiment of the present invention has a plurality of upwardly focused proximity sensors 29 attached and mounted on a proximity sensor mount 30. The proximity sensor mount 30 attached to the bottom frame member by means of screws or other comparable fasteners 31. In the preferred embodiment a motor 13 and window operator assembly 14 (shown in phantom lines) and electronic control circuit board (not shown) are mounted behind the top frame member 21 in a manner to operate the sliding pane member 16 in a manner that would be apparent to one skilled in the art. The sliding window pane member 16 is operated in a manner to facilitate an employee standing within the building to transact business with a customer standing or sitting immediately outside the access window, such as at a drive-up window in a fast-food service establishment.

Figure 4:
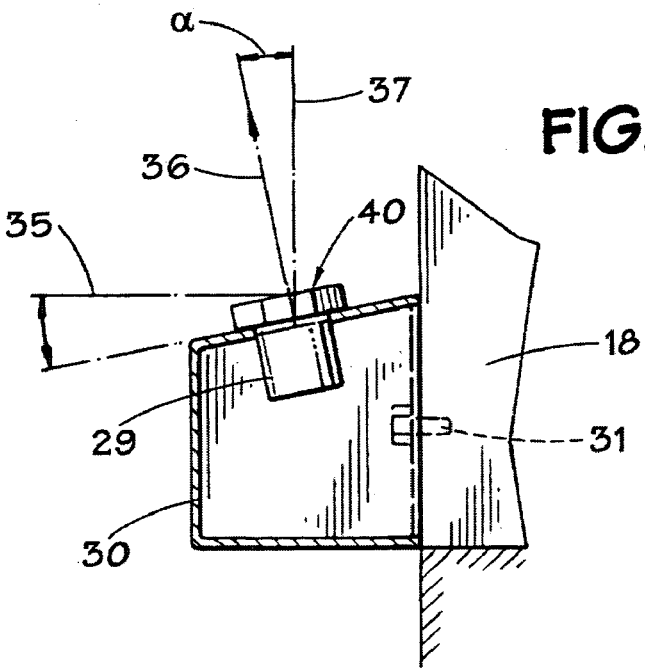
FIG. 4 is a cross-section (viewed at section line 4—4 in FIG. 3) illustrating the proximity sensor mount and the bottom window frame and further illustrating the window frame attached to the building wall.
Figure 6:
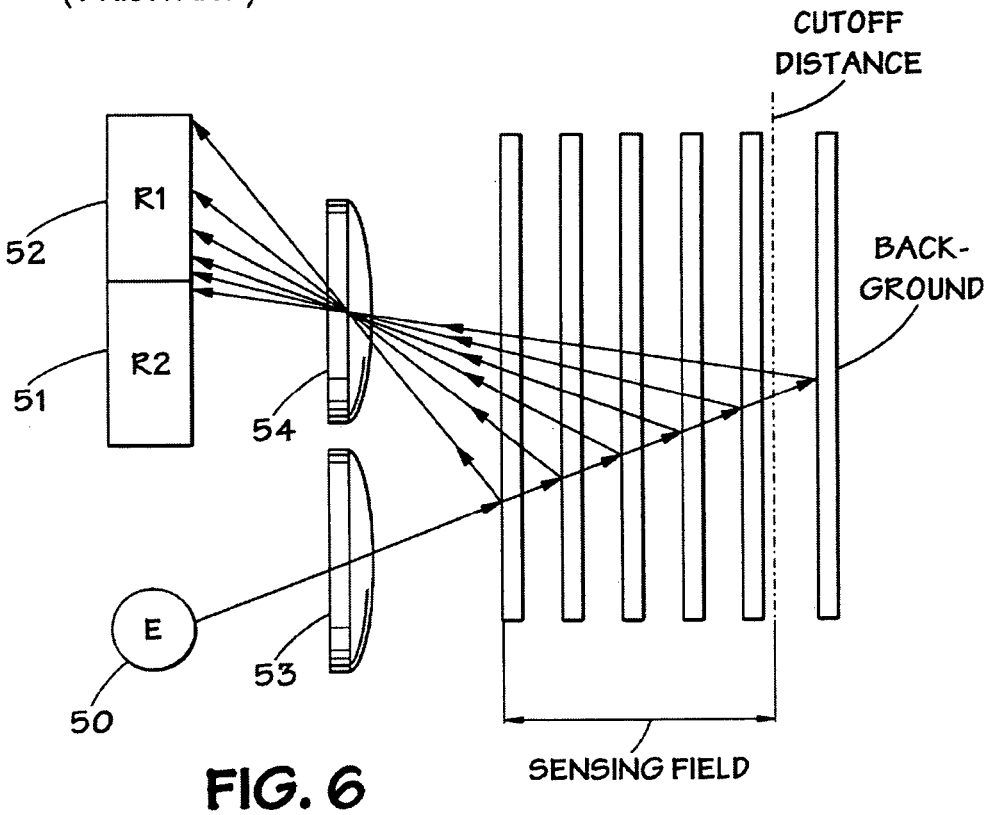
FIG. 6 is a diagram illustrating the infrared fixed-field diffused sensing arrangement used for the proximity sensors used in the present inventions.

Referring now to FIGS. 4 and 6, one of the upwardly focused proximity sensors 29 is illustrated on the sensor mount 30 in cutaway view. The proximity sensors 29 are those such as manufactured by Banner Engineering Corporation of Minneapolis, Minn. and identified by Banner Engineering Corporation as its T30 Series of Fixed-Field sensors. Each of the T30 Series proximity detectors used in the preferred embodiment of the present invention have an LED emitter, two light detectors or receivers, accompanying receiver lens and emitter lens integral in a single detector. Each of the detectors is cylindrical in configuration. In the preferred embodiment an infrared fixed-field diffused sensing arrangement is used. With the T30 sensors used in a fixed-field diffused sensing arrangement, each sensor has a single LED emitter 50 and two receivers (near receiver or detector 52 and far receiver or detector 51) positioned slightly off center of the lens focal point. This arrangement allows the light to exit the emitter lens 53 at a slight angle. The receivers in the sensor are precisely placed behind the receiver lenses 54 for the proper cutoff distance. As shown in FIG. 6, an object is sensed if the amount of light at near receiver or detector 52 (R1) is greater than the amount of light at far receiver or detector 51 (R2). In the preferred embodiment, the proximity sensors are mounted askew of the horizontal plane (illustrated by line 35) in a manner that the centerline 36 of proximity sensor 29 is slightly askew from the vertical axis (illustrated as line 37) by the angle $\alpha$. In the preferred embodiment the angle $\alpha$ is approximately 10 degrees. An angle $\alpha$ of approximately 10 degrees has been found to reliably detect an employee wishing to service a customer as the employee reaches across the horizontal service plane proximate to the access window (just prior to servicing a customer), that is as the employee extends an arm over the sensor. The employee's arm is detected before the employee's torso. This angle $\alpha$ has been found to be such that the proximity sensors substantially reject any false signals, from passing employees who do not intend to service a customer, thereby virtually eliminating the inadvertent opening of the access window. In an attempt to further avoid any false signals a 0.2 second time delay is designed into the detection circuit. As such the time delay requires the presence of a person in the proximity of the sensors for at least 0.2 of a second in order to operate properly to open the window. Similarly, a person must vacate the sensor proximity for at least 0.2 seconds for the window circuit to close the window. The angle $\alpha$ of approximately 10 degrees has also been found to be sufficient to avoid a ceiling panel or other ceiling surface from reflecting light emitted by the LED back to receivers or detectors R1 or in a manner to falsely trigger the window to open.

Another important aspect of the present invention is illustrated in FIG. 4 as ring 40. Ring 40 is manufactured from General Electric Valox (a thermoplastic material) with the outward surface of the ring shaped in a hexagonal shape. The ring is further milled out in a manner that allows dirt, water, debris, and the like to flow out of the ring and off of the lens' cover. The ring 40 is used as a mounting ring for the proximity sensor 29. The interior surface of ring 40 is circular and has an internal diameter sufficient to avoid obstructing the light emitted by the LED emitter and the light received by the receivers or detectors. In the preferred embodiment, the interior surface of ring 40 is threaded onto the threaded barrel of proximity sensor 29. In the preferred embodiment, ring 40 is a projection of a height of ⅜" or 0.375" which serves to provide sufficient infrared light travel path such that receiver R2 (in FIG. 6) can detect the presence of a person or object even is when an employee is in contact with the ring 40. Sensor ring 40 thereby serves to prevent an employee or an object of the employee's clothing from coming in direct contact with the sensor 29, which includes a lens 53, in a manner that completely eliminates receivers R2 and R1 from receiving any light emitted by emitter E.

An electrical circuit for a window motor operator including motor, electronic control and accompanying circuit board, and linkages to open and close the sliding window panel would be apparent to one skilled in the art. Typically, an electric motor is linked to the sliding window pane 16 by means of a belt drive from the output of a motor shaft. In the preferred embodiment the motor is such that it is energized and operates to open the sliding window pane whenever an employee is detected within the sensing field of the sensors 29 and the motor is thereafter reversed thereby causing the window pane 16 to close when an employee is no longer detected within the sensing field of proximity detector 29. Appropriate limit switches serve to limit the opening and closing distance of the window pane 16. In addition to typical limit switches, a clutch is typically employed together with a motor and belt drive to permit manual intervention to cause the window to open in the event of power failure or to prevent the window from continuing to open or close whenever it is partially or completely obstructed by a person, a person's limb, or an object.

Figure 5:
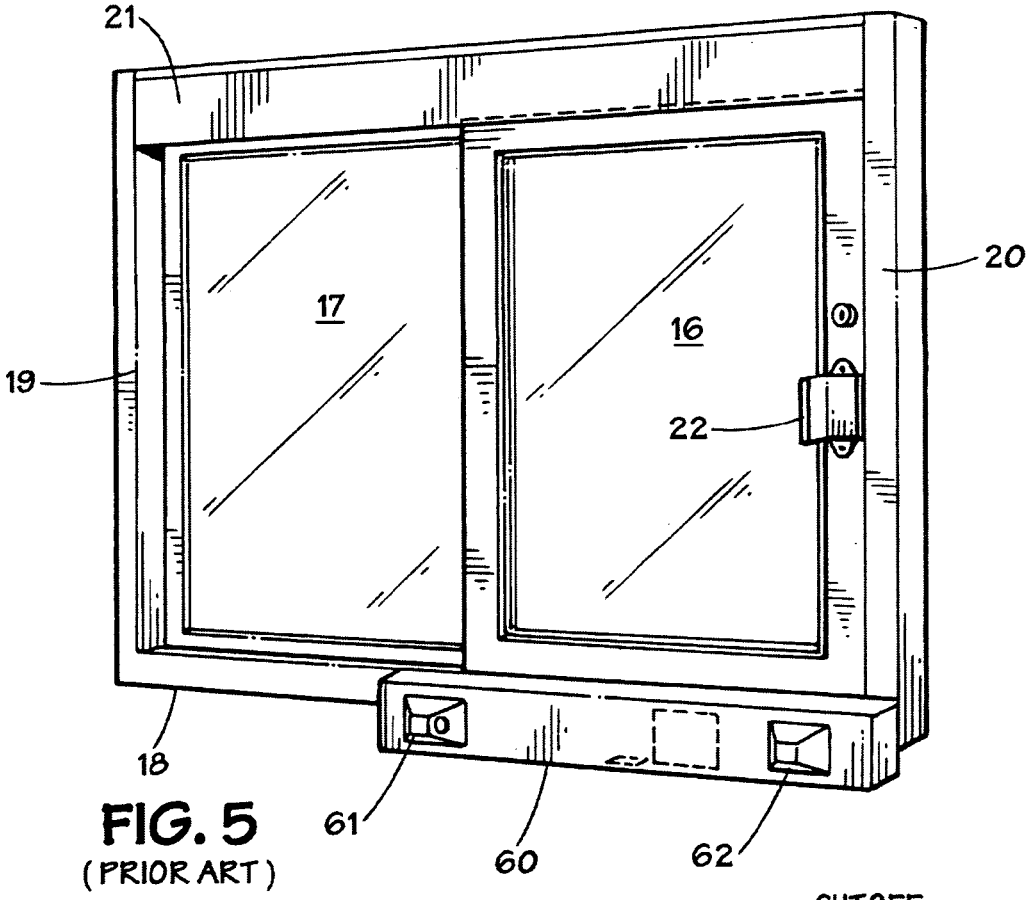
FIG. 5 (PRIOR ART)
FIG. 5 is perspective view of a prior art electrically-operated access window, with a sliding window pane, a fixed window pane, an infrared emitter, infrared receiver, and a window frame member.

FIG. 5 illustrates a prior art electrically operated window. Reference numbers are used in the same fashion and for the same members are those set forth for FIG. 1. In FIG. 5 an infrared emitter 61 and infrared receiver 62 are mounted on mount 60. The prior art device requires an employee or clerk to stand between the emitter 61 and receiver 62. In order to break the infrared beam to operate the window. The infrared beam used in this prior art device, is fairly narrow. While this narrow beam minimizes false triggering by passing employees, it also results in inadvertent closing of the window when a clerk or employee stoops over in an arching manner to service a customer rather than standing rigidly and in a manner to interrupt the infrared beam between the emitter and the receiver/detector 62.

By upwardly focusing the proximity sensors, the present invention addresses and comprehends the posture of a fast-food service employee providing service to a customer while at the same time minimizing the inadvertent opening of the fast-food service window by passing employees who are not attempting to service a customer. The present invention further addresses and comprehends the propensity of a fast-food service employee who typically presses against the horizontal service area, by providing mounting rings 40 which minimize the potential of completely blocking the light reflected from the LED emitter 50 back to the receiver/detector 52.

In view of the above, it will be seen that the other objects of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A fast-food service window comprising:

a window assembly with at least one movable window member;

a window operator assembly mechanically coupled to the movable window member;

an upwardly focused proximity sensor comprising an emitter emitting radiation and a receiver receiving radiation from the emitter, said radiation being reflected from an object being sensed, said sensor being focused upward at an angle slightly askew of a vertical axis and functionally coupled to the window operator assembly and directed to detect an extended arm of a person when said arm is extended over said proximity sensor;

wherein the movable window member opens whenever said extended arm of said person is sensed by said proximity sensor.

2. The fast-food service window set forth in claim 1 wherein the sensor has an integral infrared emitter and receiver.

3. The fast-food service window set forth in claim 1 wherein the proximity sensor is directed such that the torso of a person approaching the fast-food service window is not detected by the proximity sensor before said extended arm is detected.

4. The fast food service window set forth in claim 1 wherein said window has a bottom frame member and said proximity sensor is mounted adjacent said bottom frame member and is directed upward at an angle sufficient to permit detection of said extended arm of said person approaching the window before detection of the torso of said person approaching said window.

5. The fast food service window set forth in claim 1 wherein the proximity sensor has a lens and a projection extending beyond the lens a distance sufficient inhibit objects approaching the lens from disabling the functioning of the proximity sensor before said extended arm is detected.

6. The fast food service window set forth in claim 1 wherein said angle is not more than about 10°.

7. The fast food service window set forth in claim 6 wherein said angle is about 10°.

8. The fast-food service window set forth in claim 1 wherein the proximity sensor is surrounded by a ring which rises above the sensor.

9. The fast food service window set forth in claim 8 wherein the proximity sensor comprises an LED emitter and a receiver and wherein the ring rises above the sensor a distance sufficient for light emitted by the emitter to reflect off an object in contact with the ring and be received by the receiver.

10. A fast-food service window comprising:

a window assembly with at least one movable window member;

a window operator assembly mechanically coupled to the movable window member:

a plurality of upwardly focused proximity sensors, each of said sensors comprising an emitter emitting radiation and a receiver receiving radiation from the emitter, said received radiation being reflected from an object being sensed, said sensors being focused upward at an angle that deviates from a vertical axis by not more than about 10° and functionally coupled to the window assembly and directed to open the movable window member in response to said proximity sensors.

11. The fast-food service window set forth in claim 10 wherein each of the sensors has an integral emitter and receiver.

12. A fast-food service window comprising:

a window assembly with at least one movable window member;

a window operator assembly mechanically coupled to the movable window member;

a upwardly focused infrared proximity sensor comprising an emitter emitting radiation and a receiver receiving radiation from the emitter, said received radiation being reflected from an object being sensed, said sensor being focused upward at an angle that deviates from a vertical axis by not more than about 100 and electrically coupled to the window operator assembly and directed to detect an extended arm of a person when said arm is extended over said proximity sensor:

wherein the movable window member opens whenever said extended arm of said person is sensed by said infrared proximity sensor.

13. The fast food service window set forth in claim 12 wherein said movable window member is opened when an upwardly focused infrared beam is detected by the proximity sensor and is closed when the infrared beam is not detected by the proximity sensor.

14. The fast-food service window set forth in claim 12 wherein the sensor has an integral emitter and receiver.

* * * * *

UNITED STATES PATENT AND TRADEMARK OFFICE

CERTIFICATE OF CORRECTION

PATENT NO. : 7,032,348 B1
APPLICATION NO. : 09/004803
DATED : April 26, 2006
INVENTOR(S) : Jason T. Epps, Dan L. Terry and Jackson G. Weaver It is certified that error appears in the above-identified patent and that said Letters Patent is hereby corrected as shown below:

<u>Column 6</u>:
Line 8, after "sufficient" insert --to--;
Line 52, delete "100" and insert therefore --10°--.

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,032,348 B1
APPLICATION NO. : 09/004803
DATED : April 25, 2006
INVENTOR(S) : Jason T. Epps, Dan L. Terry and Jackson G. Weaver It is certified that error appears in the above-identified patent and that said Letters Patent is hereby corrected as shown below:

<u>Column 6</u>:
Line 8, after "sufficient" insert --to--;
Line 52, delete "100" and insert therefore --10°--.

This certificate supersedes Certificate of Correction issued August 15, 2006.

Signed and Sealed this

Nineteenth Day of September, 2006

JON W. DUDAS
*Director of the United States Patent and Trademark Office*